US005482479A

United States Patent [19]

Hayashi et al.

[11] Patent Number: 5,482,479

[45] Date of Patent: Jan. 9, 1996

[54] WATER-RESISTANT ELECTRICAL CONNECTOR PREVENTING TERMINAL MISINSERTION AND MOLD SYSTEM FOR THE MANUFACTURE THEREOF

[75] Inventors: Hiroyuki Hayashi; Eiji Saijo; Shigekazu Wakata, all of Yokkaichi, Japan

[73] Assignee: Sumitomo Wiring Systems, Ltd., Mie, Japan

[21] Appl. No.: 295,460

[22] Filed: Aug. 25, 1994

[30] Foreign Application Priority Data

Aug. 26, 1993 [JP] Japan ..... 5-235588

[51] Int. Cl.[6] ..... H01R 13/405

[52] U.S. Cl. ..... 439/736; 439/519; 439/587

[58] Field of Search ..... 439/587, 519–521, 439/595, 597, 682, 736; 264/272.11, 272.12, 272.13, 274, 277

[56] References Cited

U.S. PATENT DOCUMENTS

| | | | |
|---|---|---|---|
| 4,632,482 | 12/1986 | Punako et al. | 439/587 |
| 4,639,061 | 1/1987 | Muzslay | 439/587 |
| 4,664,461 | 5/1987 | Schubert et al. | 439/587 |
| 5,067,912 | 11/1991 | Bickford et al. | 439/736 X |

FOREIGN PATENT DOCUMENTS 3-74482 7/1991 Japan .

*Primary Examiner*—Khiem Nguyen
*Attorney, Agent, or Firm*—Wenderoth, Lind & Ponack

[57] ABSTRACT

A water-resistant electrical connector includes a housing having at least one cavity dedicated to receive a terminal fixture and at least one cavity which is configured to prevent a terminal fixture from being inserted therein. Although both of the cavities are open at opposite ends of the housing, a wall closes up the cavity which is not to receive a terminal fixture constituting an electric circuit. This wall presents water from passing through the cavity from one side of the housing to the other. A fin also extends across this cavity from an open end of the cavity to the wall to thereby prevent a terminal fixture from being inserted in the cavity and into contact with the wall. A molding system can manufacture connector housings having various combinations of the cavities configured to receive a terminal fixture and cavities which prevent a terminal fixture from being inserted therein. The molding system includes a fixed mold, a movable mold, and pairs of mold pins which are detachably mountable to the molds. One pair of the mold pins will form a cavity configured to receive a terminal fixture while another pair of the mold pins will form a cavity which will prevent a terminal fixture from being inserted therein. The respective pairs of mold pins are interchangeable so that the same molds can be used to manufacture various types of housings depending on the circuit to which the connector is applied.

5 Claims, 4 Drawing Sheets

WATER-RESISTANT ELECTRICAL CONNECTOR PREVENTING TERMINAL MISINSERTION AND MOLD SYSTEM FOR THE MANUFACTURE THEREOF

BACKGROUND OF THE INVENTION

1. Field of the Invention

This invention relates to a connector of a wire harness of an automobile or the like and, more particularly, to a connector having an improved water-resistant structure.

2. Description of the Related Art

A connector having a housing adapted to receive a terminal fixture of a wire harness of an automobile or the like is known. A terminal cavity for the reception of the terminal fixture is formed in the connector housing with the two ends of the terminal cavity constituting an insertion-side opening through which a terminal fixture is inserted and a connection-side opening through which a mating connector is inserted. That is, the terminal fixture is inserted through the insertion-side opening with the tip thereof facing the connection-side opening. Afterwards, the terminal fixture within this terminal cavity and the terminal fixture of the mating connector are connected via the connection-side opening.

Water-resistance measures in such a connector include a rubber seal fitted to the junction of the terminal fixture and the lead wires electrically connected thereto. The rubber seal forms a watertight seal at the insertion-side opening when the terminal fixture is inserted into the terminal cavity thereby preventing the penetration of water from the insertion-side opening to within the terminal cavity.

However, because such a connector is a general-use part for forming various electrical circuits, i.e. is configured depending on the circuit in which it is employed, terminal fixtures may not be inserted into all of the terminal cavities. That is, some of the terminal cavities may be left vacant. A dummy plug made of rubber and having an outer diameter similar to that of the rubber seal is commonly inserted as a water-resistant measure for such vacant cavities. Of course, whether a vacant terminal cavity like that described above will be left in the connector can be ascertained in the circuit design stage. Therefore, it is possible to forego this route and instead manufacture specialized connector housings of different specifications by means of differing molds so that excess terminal cavities to be left vacant are not formed. However, such a change in specifications involves a change in the basic structure of the mold. This creates an increase in cost because a completely different mold must be manufactured. This increase in cost is rather prohibitive. For reasons such as this, the combination of a general-use connector with dummy plugs has become commonplace in the prior art.

However, the following problems are associated with this connector.

First, the installation of the dummy plug is performed manually. Therefore, not only does the possibility exist that the dummy plug is not installed because of operator error or the like, but there is a chance that even if the dummy plug is installed it may not be installed securely and may fall out of the cavity. Thus, the prior art connector cannot be relied upon for its water resistance.

Additionally, because a dummy plug is a discrete specialized part for providing water resistance, there is the drawback of the cost associated with each dummy plug.

Furthermore, because the terminal cavity in which a terminal fixture is to be inserted and the terminal cavity in which a terminal fixture is not to be inserted have identical configurations when viewed from the insertion-side opening, there is a chance that a terminal fixture may mistakenly be inserted into a terminal cavity in which it should not have been inserted in terms of the make-up of the electric circuit to be formed.

SUMMARY OF THE INVENTION

A first object of the present invention is to provide a low-cost general purpose electrical connector housing which, despite having a terminal cavity configured to prevent a terminal fixture from being inserted therein, exhibits a reliable water-resistant characteristic.

To achieve this object, the housing the electrical connector includes a water-resistant wall which closes up the above-mentioned cavity at a location between the opposite ends of the housing. This wall prevents water from passing through the cavity. In addition, a fin extends across the cavity from one of the openings of the cavity to the water-resistant wall so as to prevent a terminal from being inserted in the cavity and into contact with the water-resistant wall.

Another object of the present invention is to provide a molding system having molds which can be readily refitted to manufacture electrical connector housings which have various combinations of cavities configured to receive a terminal fixture and cavities which are configured to prevent the insertion of a terminal fixture therein.

To achieve this object, the mold system of the present invention includes a fixed mold, a movable mold, and respective pairs of mold pins detachably mountable to the molds and interchangeable with one another. One pair of the mold pins includes respective pins which will form a cavity configured to receive a terminal fixture. In this case, the mold pins include mating portions which mate with one another when the molds are closed so as to form a contiguous member extending axially through the mold (resin) cavity. On the other hand, another set of mold pins includes pins which will remain spaced apart from one another when the movable mold is closed such that the resin filling the space between the mold pins will form the water-resistant wall of a cavity configured to prevent the insertion of a terminal fixture therein. Of this pair of mold pins, one mold pin includes parallel spaced-apart protrusions defining a void therebetween. Resin filling this void forms the fin extending across the cavity between the wall and an end of the housing.

These and other objects, features and advantages of the present invention will become more apparent by referring to the detailed description of a preferred embodiment thereof made below with reference to the accompanying drawings.

DETAILED DESCRIPTION OF THE PREFERRED EMBODIMENTS

Figure 1:
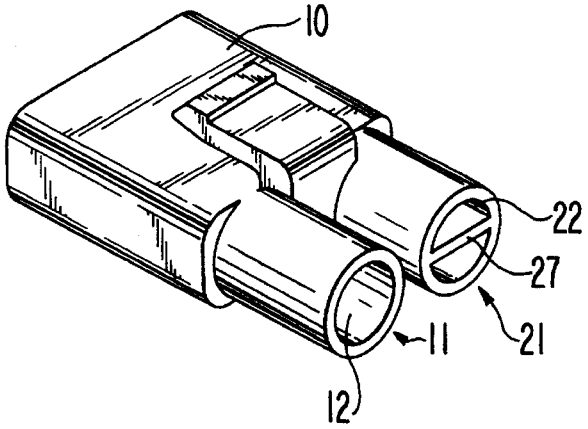
FIG. 1 is a perspective view of an embodiment of a housing of an electrical connector according to the present invention.
Figure 2:
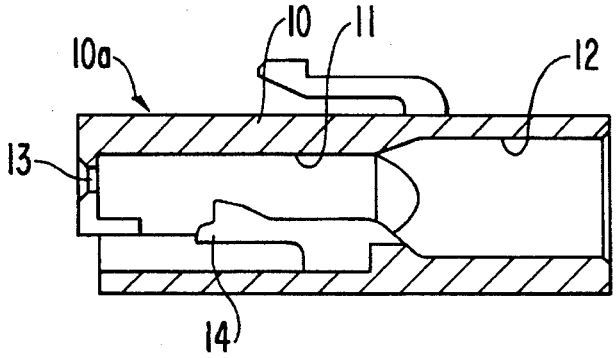
FIG. 2 is a sectional view of the connector housing taken along line 2—2 of FIG. 3, i.e. taken through a cavity configured to receive a terminal fixture.
Figure 3:
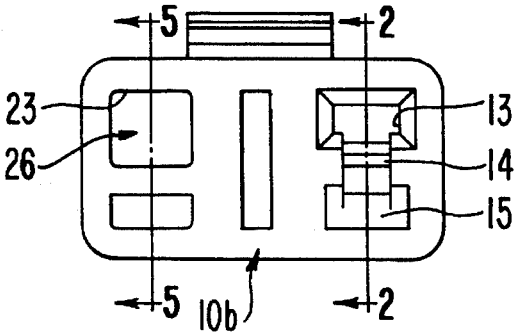
FIG. 3 is a front view of the connector housing.
Figure 4:
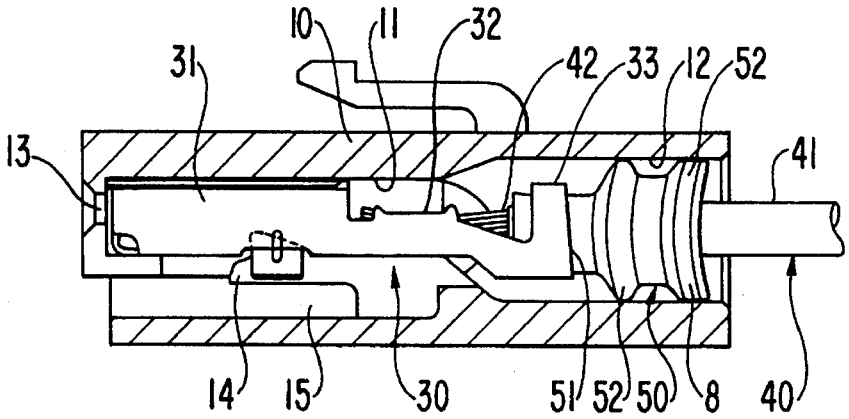
FIG. 4 is a view similar to FIG. 2 but showing the terminal fixture received in the terminal cavity.

As shown in FIG. 4, a terminal fixture 30 includes, at the distal end (left-hand side of the drawing) thereof, a female connection portion 31 which is adapted to receive a male terminal fixture of a mating side connector (not illustrated). The terminal fixture 30 also includes, at the proximal end thereof, a wire barrel 32 and an insulation barrel 33. Additionally, a tubular rubber seal 50 is fitted onto a tip of insulation 41 of an electrical wire 40 which is connected to the terminal fixture 30. A tube 51 of the rubber seal 50 is secured to the electrical wire 40 by crimping the insulation barrel 33 of the terminal fixture 30 thereto so that the rubber seal 50 becomes integral with the terminal fixture 30. Moreover, the wire core 42 of the electrical wire 40 is crimped by the wire barrel 32 of the terminal fixture 30 so that the electrical wire 40 and terminal fixture 30 assume an electrically connected state.

Referring now to FIGS. 1–4, a terminal cavity 11 is defined within the connector housing 10 to receive the terminal fixture 30. More specifically, the housing 10 includes a unitary outer peripheral wall 10*a* defining an interior space of the housing, and a partition 10*b* dividing the interior space into a plurality of cavities 11 or 11, 21 open at opposite ends of the housing. Each cavity 11 is entirely open as between the opposite ends of the housing and includes an insertion-side opening 12 through which the terminal fixture 30 is inserted, and a connection-side opening 13 through which the male terminal fixture of a mating connector (not shown) is inserted to be mated with the tip of the terminal fixture 30 within the terminal cavity 11. A lance 14 in the form of a cantilever extending toward the connection-side opening 13 forms a unitary part of the connector housing near the connection-side opening 13 within the terminal cavity 11. A space 15 in which the lance 14 is allowed to flex is maintained beneath the lance 14.

The terminal fixture 30 provided with the rubber seal 50 is inserted into the terminal cavity 11 from the insertion-side opening 12, and the lance 14 snaps into an engagement hole (not shown) in the terminal fixture 30 to prevent the displacement thereof. Additionally, when the terminal fixture 30 has been inserted into the terminal cavity 11, a lip 52 provided on the rear half of the rubber seal 50 seals the insertion-side opening 12 of the terminal cavity 11 in a watertight state, thereby preventing the penetration of water into the terminal cavity 11 from the insertion-side opening 12.

Figure 5:
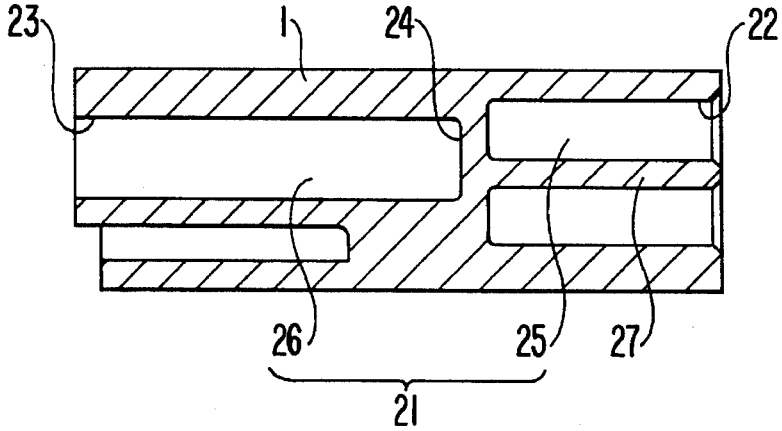
FIG. 5 is a sectional view of the connector housing taken along line 5—5 in FIG. 3, i.e. through a vacant cavity in which a terminal fixture is not to be received.
Figure 6:
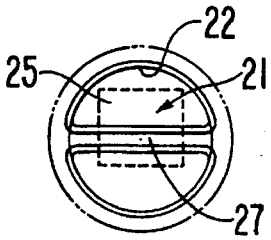
FIG. 6 is a rear view (from a connection-side opening) of the vacant cavity in which a terminal fixture is not to be received.

A vacant cavity 21 into which a terminal fixture 30 is not to be inserted is depicted in FIG. 5 and FIG. 6. A water-resistant wall 24 is located within the vacant cavity 21 between an insertion-side opening 22 and a connection-side opening 23 at a location somewhat closer to the insertion-side opening 22 so as to isolate the two openings from one another. This water-resistant wall 24 closes up the interior of the vacant cavity 21 so as to form two separated spaces, i.e. an insertion-side space 25 having a circular cross section and a connection-side space 26 having a square cross section, and provides a watertight seal between these two spaces 25 and 26.

Additionally, a misinsertion-prevention fin 27 is formed unitarily with outer wall 10*a* within the insertion-side space 25. This misinsertion-prevention fin 27 extends across the space 25 from the insertion-side opening 22 to the water-resistant wall 24 to in turn divide the insertion-side space 25 vertically into two spaces each having a semicircular cross section.

Figure 7:
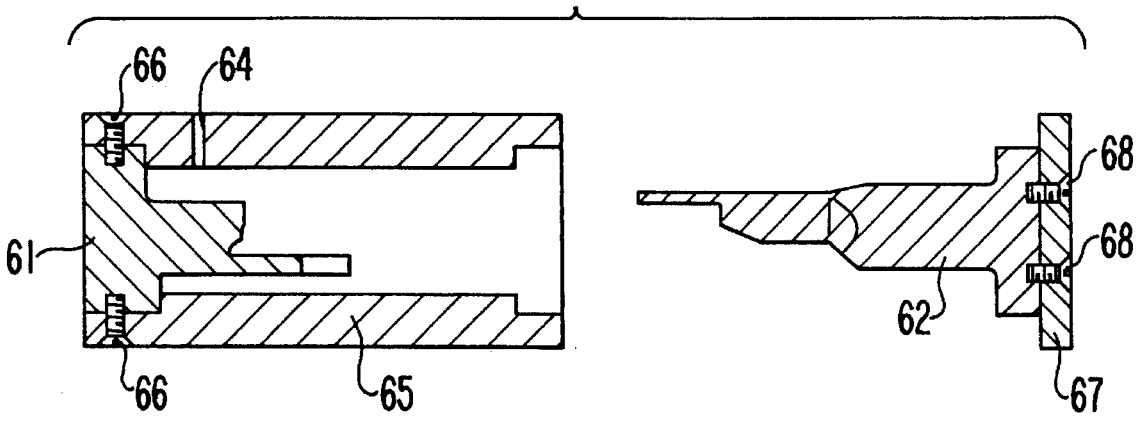
FIG. 7 is a sectional view of a mold, in an open state, for forming a terminal cavity in which a terminal fixture is to be received according to the present invention.
Figure 8:
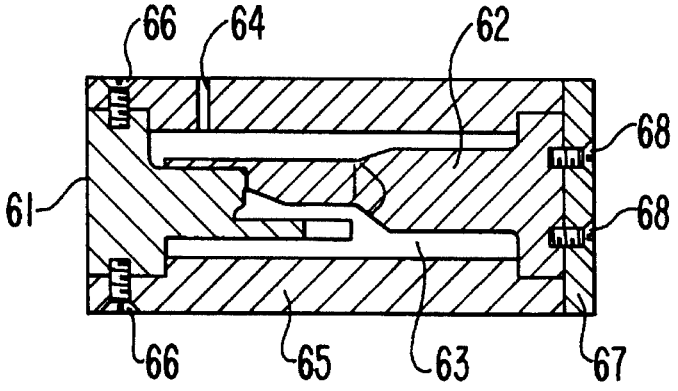
FIG. 8 is a sectional view of the mold in a closed state.

A portion of the molds for forming the above-described terminal cavity 11 configured to receive the terminal fixture 30 is depicted in FIGS. 7 and 8. Briefly, FIG. 7 depicts an open state of the molds. A mold pin 61 for forming the connection-side opening of the terminal cavity 11 and the lance-flexing space 15 is shown on the left-hand side of the drawing, and a mold pin 62 for forming the insertion-side opening 12 is shown on the right-hand side of the drawing. The mold pin 61 is removably attached to a fixed mold 65 by bolts 66, and the pin 62 is removably attached to a moving mold 67 by bolts 68. Once the moving mold 67 with pin 62 has moved toward the fixed mold 65 and the two molds 65 and 67 assume a closed state (FIG. 8), resin is injected through a gate 64 of the fixed mold 65 into a resin cavity 63. As is quite evident, the pin 61, 62 of this pair have mating portions 61*a*, 62*a* which mate with one another to form a contiguous member extending axially through cavity 63. Thus, these mating portions form the cavity 11 entirely open between the opposite ends of housing 10.

Figure 9:
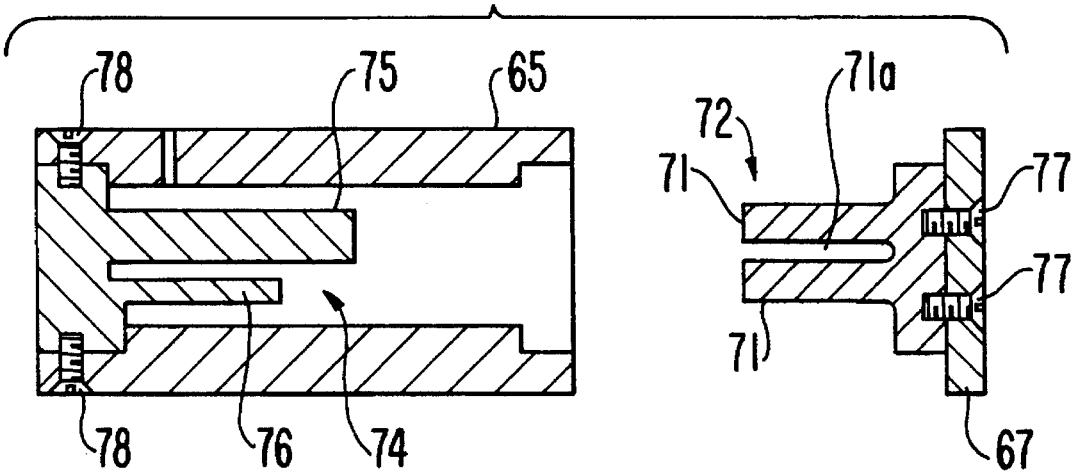
FIG. 9 is a sectional view of the mold in an open state but refitted to form a vacant cavity in which a terminal fixture is not to be received.
Figure 10:
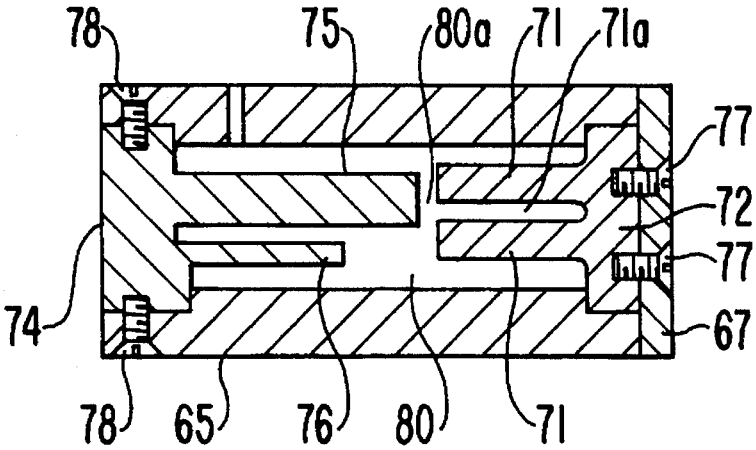
FIG. 10 is a sectional view of the mold shown in FIG. 9 but in a closed state.

The vacant cavity 21 which will not receive the terminal fixture 30 is formed by molds depicted in FIGS. 9 and 10, for example. FIG. 9 shows the molds in an open state. The vacant cavity molding portion comprises another pair of pins, namely an insertion-side mold pin 72 and a connection-side mold pin 74. The mold pin 73 includes two protrusions 71 each having a semicircular cross section and disposed parallel to another across a void 71*a*. The mold pin 74 includes two protrusions 75 and 76 each having a square cross section and facing each other. The insertion-side mold pin 72 is removably attached to the moving mold 67 by bolts 77 and the connection-side mold pin 74 is removably attached to the fixed mold 65 by bolts 78. When the molds 65 and 66 are closed as shown in FIG. 10, resin is injected through the gate 64 into a resin cavity 80. These two mold pins 72 and 74 are removably attached to the molds 67 and 65 so as to be interchangeable with the above-described mold pins 61 and 62 for forming the terminal cavity 11. As is evident from FIG. 10, the pins 72, 74 are spaced apart from one another in the axial direction of cavity 80 so as to allow resin to fill an entire cross-sectional portion 80*a* of the cavity whereat the wall 24 will be formed. The void 71*a* opens into this space (cross-sectional portion 80*a* of the cavity 80) whereby resin fills the void 71*a* to form the fin 27.

To form a connector housing 10 in which all of the cavities are to be adapted to receive terminal fixtures 30, only sets of the mold pins 61 and 62 are used. Then, when a connector housing is to be made in which one or more of the terminal cavities is to remain vacant in consideration of the circuit with which the connector is to be employed, a set(s) of the mold pins 61 and 62 are removed and mold pins 72 and 74 are installed in their place at portions of the molds 65, 66 corresponding to those vacant cavities. Therefore, a vacant cavity 21 as shown in FIG. 5 can be formed in the connector housing 10 by each such set of mold pins 72 and 74.

When installing a terminal fixture 30 in a connector housing 10 having the two types of cavities 11 and 21 described above, the determination of which of the two cavities 11 and 21 is to receive the terminal fixture 30 can be made by visually examining the connector housing from the insertion side and confirming the presence or absence of the misinsertion-prevention fin 27 at the insertion-side openings 12 and 22. The terminal fixture 30 should be inserted into the insertion-side opening which does not have the misinsertion-prevention fin 27, i.e. into the terminal cavity 11. If, at this time, an attempt is made to insert the terminal fixture 30 into the vacant cavity 21, the tip of the terminal fixture 30 strikes the misinsertion-prevention fin 27, whereby the fixture 30 cannot be mistakenly inserted into the cavity 21.

Water-resistance at the terminal cavity 11 into which the terminal fixture 30 is inserted is provided by the rubber seal 50 disposed in the insertion-side opening 12 together with the terminal fixture 30.

There is no particular need for discrete water-resistance measures for the vacant cavity 21 into which the terminal fixture 30 is not to be inserted. This is because of the fact that, with regard to this vacant cavity 21 into which the terminal fixture 30 is not to be inserted, even if water enters the vacant cavity 21 from the insertion-side opening 22, the penetration of the water to the connection-side opening 15 is reliably prevented by the water-resistant wall 24. Consequently, this embodiment possesses a reliable water-resistant characteristic. This water-resistant characteristic cannot be lost, as in the prior art, by forgetting to install a dummy plug or by the dislodgement of a dummy plug from the cavity.

Furthermore, compared to the connector of the prior art requiring a dummy plug, the present invention is less costly to produce as it has a fewer number of parts. Further, in this respect, since there is no assembly step required for providing the vacant cavity 21 with a water-resistant characteristic, the connector can be manufactured more efficiently in less man-hours.

Additionally, because of the misinsertion-prevention fin 27, manufacturing efficiency is not adversely affected by mistakes in the insertion of the terminal fixtures. Moreover, the terminal fixture 30 is never allowed a strike and damage the water-resistant wall 24.

In addition, when forming a connector housing 10 having a vacant cavity 21 in which a terminal fixture 30 is not to be inserted, a set of the mold pins 61 and 62 can be merely replaced with the mold pins 72 and 74. The fundamental mold production portion remains unchanged and so there is no need to manufacture and maintain completely different molds, whereby cost savings are realized with respect to the molds.

It is conceivable to form the water-resistant wall 24 at the insertion-side opening of the vacant cavity 21 and omit the misinsertion-prevention fin 27. However, in this case the mold pin 72 must be excessively long and strength-related problems arise. In the present embodiment, the location of the water-resistant wall 24 has been established at about the center of the terminal cavity 21 in consideration of this, and a fin 27 has been provided in order to present an erroneous insertion of the terminal fixture.

Furthermore, the connector of the present invention has been described as having two cavities 11 and 21. However, the present invention can apply to a connector provided with any number of cavities. Moreover, the connector may have any number of terminal cavities in which terminal fixtures are to be inserted and any number of vacant cavities in which terminal fixtures are not to be inserted.

Finally, although the various portions of the connector housing have been described above as "unitary", it is clear that the molding system can manufacture each connector housing as one piece.

Various other changes and modifications will become apparent to those of ordinary skill in the art. All such changes and modifications are seen to be within the true spirit and scope of the invention as defined by the appended claims.

What is claimed is:

1. A connector housing of an electrical connector comprising: an outer peripheral wall defining an interior space of the housing, a partition unitary with the outer peripheral wall and dividing said interior space into a plurality of cavities, each of said cavities being open at opposite ends of the housing, at least one of said cavities being entirely open as between said opposite ends of the housing and configured to receive a terminal fixture constituting an electrical circuit, a water-resistant wall unitary with said outer peripheral wall and closing up at least one of the other of said cavities at a location between the opposite ends of the housing so as to form two separated spaces between said wall and one of the ends of the housing and between said wall and the other of the ends of the housing, and a fin unitary with said outer peripheral wall and located in one of said two separated spaces so as to prevent a terminal from being inserted in said other of said cavities and into contact with said water-resistant wall.

2. A connector housing as claimed in claim 1, wherein said fin extends across said one of said two spaces from an end of said housing to said water-resistant wall.

3. An electrical connector comprising:

a connector housing including an outer peripheral wall defining an interior space of the housing, a partition unitary with the outer peripheral wall and dividing said interior space into a plurality of cavities, each of said cavities being open at opposite ends of the housing, at least one of said cavities being entirely open as between said opposite ends of housing, a water-resistant wall unitary with said outer peripheral wall and closing up at least one of the other of said cavities at a location between the opposite ends of the housing so as to form two separated spaces between said wall and one of the ends of the housing and between said wall and the other of the ends of the housing, and a fin unitary with said outer peripheral wall and located in one of said two separated spaces so as to prevent a terminal from being inserted in said other of said cavities and into contact with said water-resistant wall; a respective terminal fixture fitted to the housing in each said at least one of the cavities that is entirely open between said opposite ends of the housing; and an electrical wire electrically conductively connected to the terminal fixture.

4. A connector housing as claimed in claim 1, wherein said fin extends across said one of said two spaces from an end of said housing to said water-resistant wall.

5. A molding system for use in forming housings of electrical connectors, each of said housings having at least one cavity entirely open between both ends of the housing and configured to receive a terminal fixture, and at least some of which housings also have at least one cavity which is configured to prevent a terminal fixture from being inserted therein, said system comprising:

a fixed mold;

a movable mold movable toward and away from said fixed mold between open and closed mold positions;

a plurality of pairs of mold pins, one of the mold pins of each of said pairs being detachably mountable to the fixed mold and the other of the mold pins of each of said pairs being detachably mountable to the movable mold, the molds and each respective said pair of mold pins mounted thereto defining a resin cavity when the movable mold is in said closed position, the mold pins of one of said pairs having respective portions which mate with one another and form a contiguous member extending axially through the resin cavity when attached to said molds, respectively, so as to form a said cavity open entirely between both ends of the housing, the mold pins of another of said pairs being spaced apart from one another in an axial direction of the resin cavity when attached to said molds, respectively, so as to allow resin to fill an entire cross-sectional portion of the resin cavity and form a wall between open ends of the housing, one of the mold pins of said another of said pairs having parallel spaced-apart protrusions defining a void therebetween and extending toward the other mold pin of the another of said pairs with the void between said protrusions opening into the space left between the mold pins of said another of said pairs when the movable mold is in the closed position such that resin entering the void between the protrusions forms a fin extending from said wall to an open end of the housing, and said one pair of mold pins being exchangeable for said another pair of mold pins whereby said molds can be used to manufacture both housings having at least one said cavity configured to receive a terminal fixture and housings having at least one said cavity configured to prevent a terminal fixture from being inserted therein.

* * * * *